US010434775B2

(12) United States Patent
Nishimura

(10) Patent No.: US 10,434,775 B2
(45) Date of Patent: Oct. 8, 2019

(54) PRINTHEAD DESIGN THAT MOUNTS AT DIFFERENT ANGLES TO PRINT AT MULTIPLE RESOLUTIONS

(71) Applicant: Hiroshi Nishimura, West Hills, CA (US)

(72) Inventor: Hiroshi Nishimura, West Hills, CA (US)

(73) Assignee: Ricoh Company, Ltd., Tokyo (JP)

( * ) Notice: Subject to any disclaimer, the term of this patent is extended or adjusted under 35 U.S.C. 154(b) by 21 days.

(21) Appl. No.: 15/808,765

(22) Filed: Nov. 9, 2017

(65) Prior Publication Data

US 2019/0134978 A1 May 9, 2019

(51) Int. Cl.
*B41J 2/145* (2006.01)
*B41J 2/14* (2006.01)

(52) U.S. Cl.
CPC ..... *B41J 2/145* (2013.01); *B41J 2/1433* (2013.01)

(58) Field of Classification Search
CPC ..... B41J 2/1752; B41J 29/38; B41J 2/1433; B41J 2/145
USPC ..... 347/40, 41, 47
See application file for complete search history.

(56) References Cited

U.S. PATENT DOCUMENTS

2012/0044512 A1* 2/2012 Truong ..... B41J 2/14 358/1.9
2015/0197090 A1* 7/2015 Akahane ..... B41J 2/1433 347/47

* cited by examiner

*Primary Examiner* — Jannelle M Lebron
(74) *Attorney, Agent, or Firm* — Duft & Bornsen, PC

(57) ABSTRACT

Printheads for a jetting apparatus that may be oriented at different angles to print at different resolutions. In one embodiment, a printhead has a nozzle plate with nozzles arranged in rows that are parallel, and attachment members. The nozzles in each of the rows are spaced by a nozzle distance, and the rows of nozzles are spaced at a distance of ¾n times the nozzle distance. The attachment members may orient the printhead at an angle that is perpendicular to a direction of relative movement between the printhead and a print medium to print at a one resolution, and may orient the printhead at another angle (in a range of 36 and 38 degrees) to the direction of relative movement between the printhead and the print medium to print at a higher resolution.

19 Claims, 15 Drawing Sheets

PRINTHEAD DESIGN THAT MOUNTS AT DIFFERENT ANGLES TO PRINT AT MULTIPLE RESOLUTIONS

FIELD OF THE INVENTION

The following disclosure relates to the field of image formation, and in particular, to printheads and the use of printheads.

BACKGROUND

Image formation is a procedure whereby a digital image is recreated on a medium by propelling droplets of ink or another type of print fluid onto a medium, such as paper, plastic, a substrate for 3D printing, etc. Image formation is commonly employed in apparatuses, such as printers (e.g., inkjet printer), facsimile machines, copying machines, plotting machines, multifunction peripherals, etc. The core of a typical image forming apparatus is one or more liquid-droplet ejection heads (referred to generally herein as "printheads") having nozzles that discharge liquid droplets, a mechanism for moving the printhead and/or the medium in relation to one another, and a controller that controls how liquid is discharged from the individual nozzles of the printhead onto the medium.

The nozzles of a printhead may be aligned in one or more rows along a discharge surface of the printhead. The printhead is mounted in the image forming apparatus so that the discharge surface is facing the medium. In a typical image forming apparatus, the printhead is mounted so that the row or rows of nozzles are oriented perpendicular to the direction of relative movement between the printhead and the medium. For example, when the printhead is fixed in the image forming apparatus, a mechanism in the image forming apparatus may move the medium in a feed direction that is perpendicular to the row(s) of nozzles. Often times, nozzle density (i.e., Nozzles Per Inch (NPI)) of the printhead is not high enough for single pass printing. Thus, manufacturers continue to look for ways to increase nozzle density for printing.

SUMMARY

Embodiments described herein provide for printhead designs and mounting orientations within a jetting apparatus, such as an inkjet printer, to increase print resolution. A printhead as described herein includes rows of nozzles that are spaced apart by a particular distance. With this row spacing, the printhead may be mounted in the jetting apparatus perpendicular to the direction of relative movement between the printhead and the medium for lower resolution printing, and may be mounted in the jetting apparatus at a particular angle to the direction of relative movement between the printhead and the medium for higher resolution printing. One benefit is that the same printhead may be used at different orientations to print at different resolutions.

One embodiment comprises one or more printheads having a nozzle plate with nozzles arranged in rows that are parallel, and attachment members. The nozzles in each of the rows are spaced by a nozzle distance, and the nozzles in one row are offset from the nozzles in other rows. The rows of nozzles are spaced at a distance of ¾n times the nozzle distance, where n is a natural number. The printhead(s) mount to a mount mechanism of a jetting apparatus in the following configurations: (1) the attachment members connect to a mount mechanism of the jetting apparatus to orient the printhead at a first angle that is perpendicular to a direction of relative movement between the printhead and a print medium to print at a first resolution, and (2) the attachment members connect to the mount mechanism of the jetting apparatus to orient the printhead at a second angle (in a range of 36 and 38 degrees) to the direction of relative movement between the printhead and the print medium to print at a higher resolution than the first resolution.

In one embodiment, the second angle comprises arccos (⅘) degrees.

In one embodiment, the printheads include a first printhead and a second printhead connected to the mount mechanism of the jetting apparatus at the second angle. A first row of nozzles in the first printhead is spaced at the distance of ¾n times the nozzle distance from a second row of nozzles in the second printhead.

In one embodiment, the rows of nozzles include a first row and a second row. The nozzles in the first row are offset from the nozzles in the second row by ½ times the nozzle distance.

In one embodiment, the jetting apparatus comprises an inkjet printer.

In one embodiment, the inkjet printer performs single-pass printing.

Another embodiment comprises one or more printheads having a nozzle plate with nozzles arranged in rows that are parallel, and attachment members. The nozzles in each of the rows are spaced by a nozzle distance, and the nozzles in one row are offset from the nozzles in other rows. The rows of nozzles are spaced at a distance of ⅔n times the nozzle distance, where n is a natural number. The printhead(s) mount in a jetting apparatus in the following configurations: (1) the attachment members connect to a mount mechanism of the jetting apparatus to orient the printhead at a first angle that is perpendicular to a direction of relative movement between the printhead and a print medium to print at a first resolution, and (2) the attachment members connect to the mount mechanism of the jetting apparatus to orient the printhead at a second angle (in a range of 52 and 54 degrees) to the direction of relative movement between the printhead and the print medium to print at a higher resolution than the first resolution.

In one embodiment, the second angle comprises arccos (⅗) degrees.

Another embodiment comprises one or more printheads having a nozzle plate with nozzles arranged in rows that are parallel, and attachment members. The nozzles in each of the rows are spaced by a nozzle distance, and the nozzles in one row are offset from the nozzles in other rows. The rows of nozzles are spaced at a distance of 12n times the nozzle distance, where n is a natural number. The printhead(s) mount in a jetting apparatus in the following configurations: (1) the attachment members connect to a mount mechanism of the jetting apparatus to orient the printhead at a first angle that is perpendicular to a direction of relative movement between the printhead and a print medium to print at a first resolution, (2) the attachment members connect to the mount mechanism of the jetting apparatus to orient the printhead at a second angle (in a range of 52 and 54 degrees) to the direction of relative movement between the printhead and the print medium to print at a second resolution that is higher than the first resolution, and (3) the attachment members connect to the mount mechanism of the jetting apparatus to orient the printhead at a third angle (in a range of 36 and 38 degrees) to the direction of relative movement between the printhead and the print medium to print at a third resolution that is higher than the first resolution and the second resolution.

In one embodiment, the second angle comprises arccos (3/5) degrees.

In one embodiment, the third angle comprises arccos (4/5) degrees.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific illustrative embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
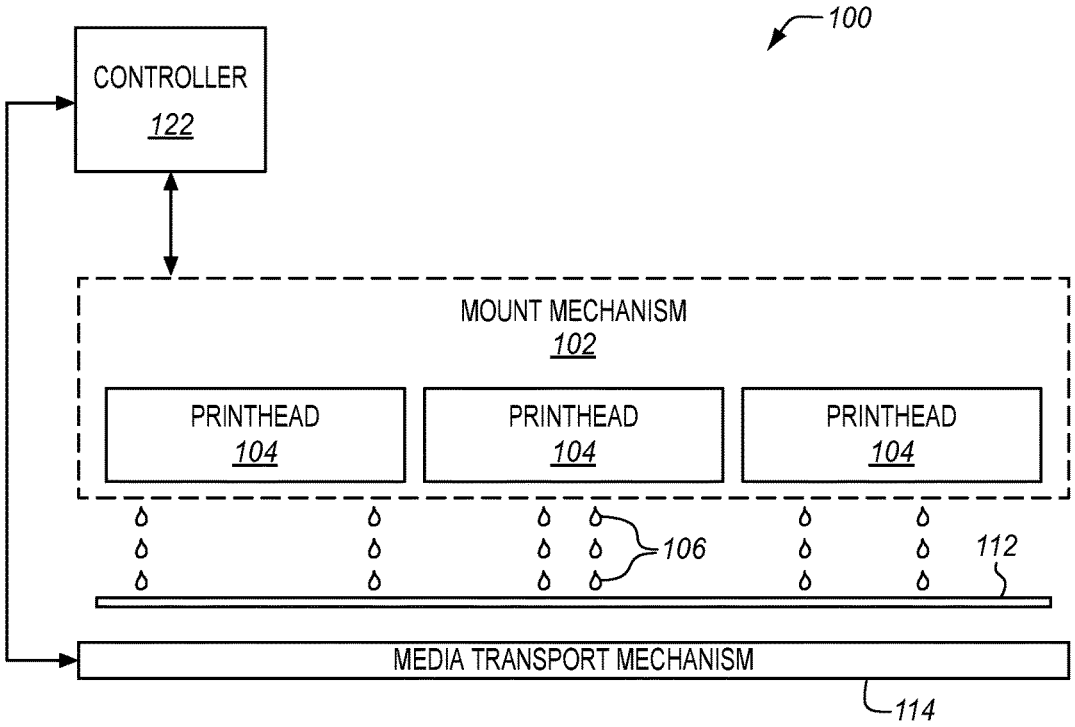
FIG. 1 is a schematic diagram of a jetting apparatus in an illustrative embodiment.

FIG. 1 is a schematic diagram of a jetting apparatus 100 in an illustrative embodiment. One example of jetting apparatus 100 is an inkjet printer that performs single-pass or multi-pass printing. Jetting apparatus 100 includes a mount mechanism 102 that supports one or more printheads 104 above a medium 112. Mount mechanism 102 may comprise a carriage assembly that reciprocates back and forth along a scan line or scan directions for multi-pass printing. Alternatively, mount mechanism 102 may be fixed within jetting apparatus 100 for single-pass printing. Printheads 104 are a device, apparatus, or component configured to eject droplets 106 of a print fluid, such as ink (e.g., water, solvent, oil, or UV-curable), through a plurality of orifices or nozzles (not visible in FIG. 1). The droplets 106 ejected from the nozzles of printheads 104 are directed toward medium 112. Medium 112 comprises any type of material upon which ink or another print fluid is applied by a printhead, such as paper, plastic, card stock, transparent sheets, a substrate for 3D printing, cloth, etc. Typically, nozzles of printheads 104 are arranged in one or more rows so that ejection of print fluid from the nozzles causes formation of characters, symbols, images, layers of an object, etc., on medium 112 as printhead 104 and/or medium 112 are moved relative to one another. Media transport mechanism 114 is configured to move medium 112 relative to printheads 104. Jetting apparatus 100 also includes a controller 122 that controls the overall operation of jetting apparatus 100. Controller 122 may connect to a data source to receive printable data, and control each printhead 104 to discharge the print fluid on a desired pixel grid on medium 112.

Figure 2:
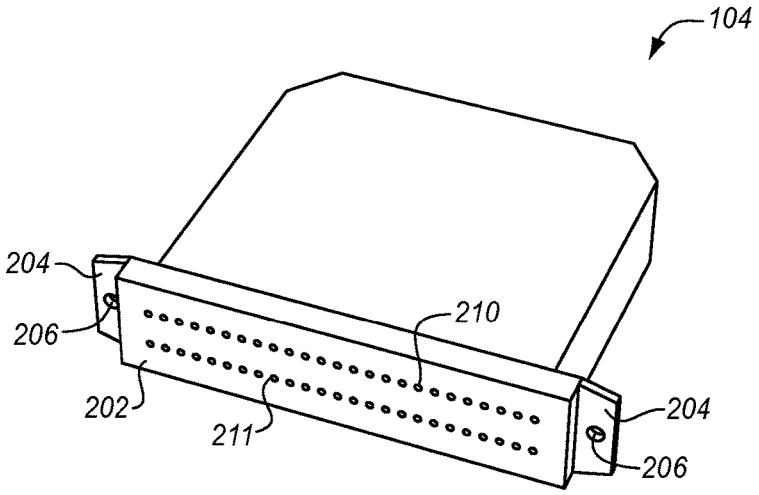
FIG. 2 is an isometric view of a printhead in an illustrative embodiment.
Figure 3A:
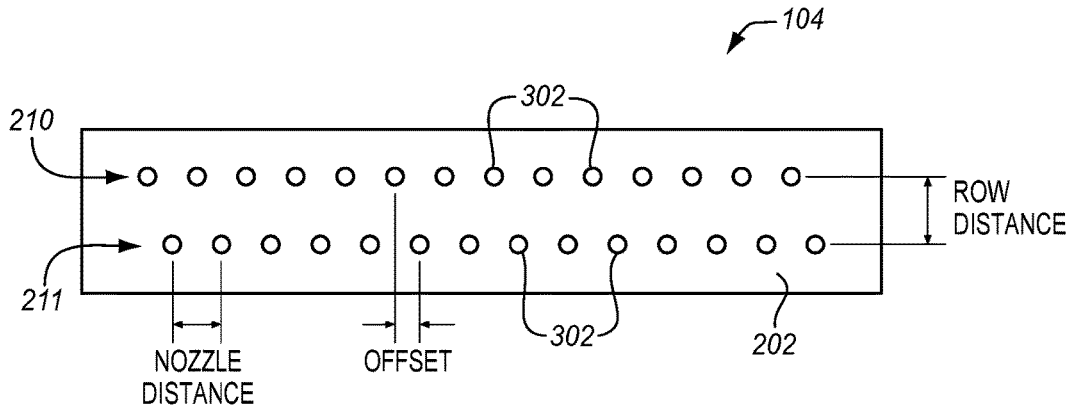
FIGS. 3A, 3B, and 3C illustrate examples of a nozzle plate of a printhead in an illustrative embodiment.
Figure 3B:
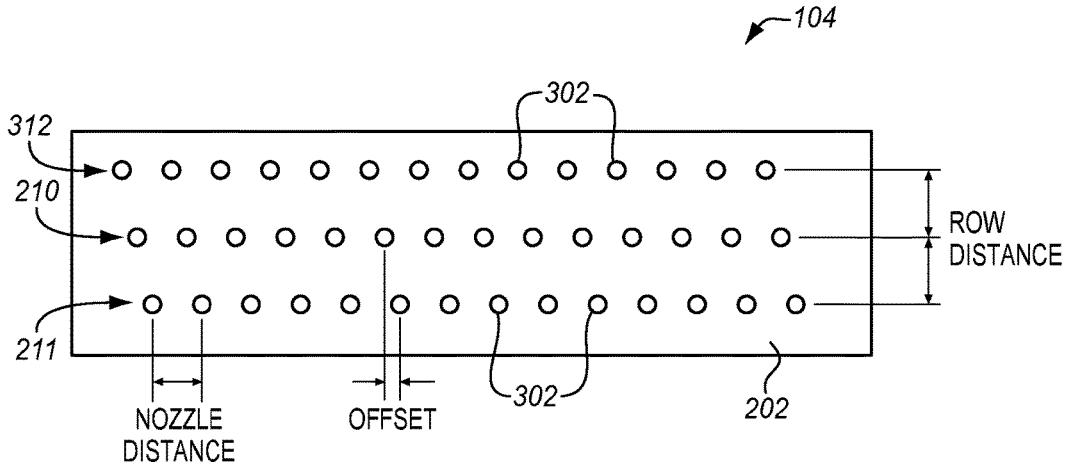
Figure 3C:
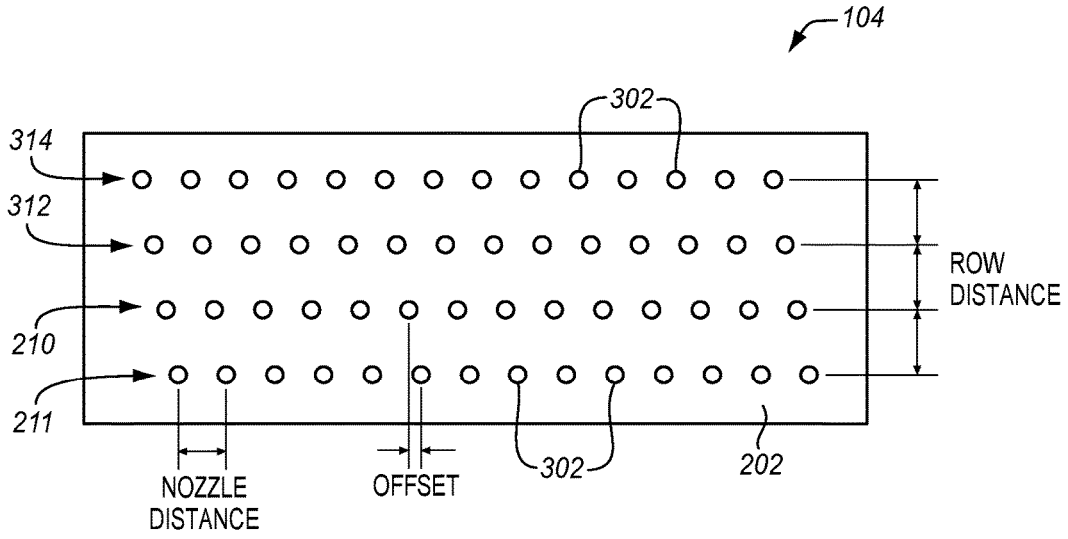

FIG. 2 is an isometric view of printhead 104 in an illustrative embodiment. Printhead 104 includes a nozzle plate 202, which represents the discharge surface of printhead 104 that includes a plurality of nozzles. The nozzles of printhead 104 are arranged in rows 210-211. Although two rows 210-211 of nozzles are illustrated in FIG. 2, printhead 104 may include a single row of nozzles, three rows of nozzles, four rows of nozzles, etc., such as is illustrated in FIGS. 3A-3C. Printhead 104 also includes attachment members 204. Attachment members 204 are configured to secure printhead 104 to a jetting apparatus, such as to mount mechanism 102 as illustrated in FIG. 1. Attachment members 204 may include one or more holes 206 so that printhead 104 may be mounted within a jetting apparatus by screws, bolts, pins, etc.

FIGS. 3A-3C illustrate examples of nozzle plate 202 of printhead 104 in an illustrative embodiment. In FIG. 3A, nozzle plate 202 includes nozzles 302 that are arranged in rows 210-211. The number of nozzles 302 in each row 210-211 is reduced for clarity, as an actual row may have 192 or more nozzles. Printhead 104 is designed so that rows 210-211 are aligned in parallel with a specific distance between rows 210-211, which is referred to as the row distance (RD). Printhead 104 is also designed with a specific distance between each successive nozzle 302 in a row 210-211, which is referred to as the nozzle distance (ND). Printhead 104 is also designed with an offset between rows 210-211, which means that nozzles 302 in row 210 are out of line by a specific amount with nozzles 302 in row 211. The offset may be determined by ND/x, where x is the number of rows in the printhead. For example, when there are two rows 210-211 as shown in FIG. 3A, the offset of the nozzles 302 is ND/2. When there are three rows 210-211 and 312 as shown in FIG. 3B, the offset of the nozzles 302 is ND/3. When there are four rows 210-211 and 312-313 as shown in FIG. 3C, the offset of the nozzles 302 is ND/4.

Figure 4:
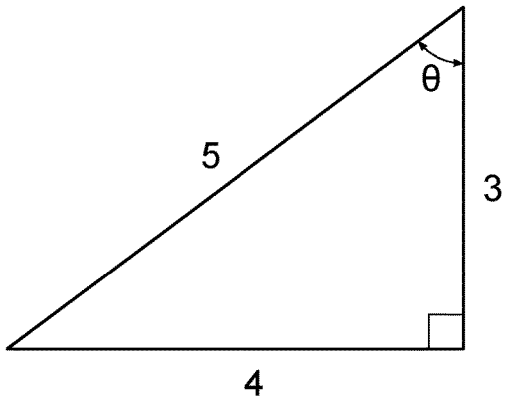
FIG. 4 illustrates the geometry of a 3-4-5 triangle.

In the embodiments described below, printheads are designed with specific specifications so that they can be used at different angles. The designs are based on the geometry of a 3-4-5 triangle as shown in FIG. 4. In a first embodiment, the row distance is ¾n×ND, where n is a natural number. In a second embodiment, the row distance is ⅔n×ND. In a third embodiment, the row distance is 12n×ND. Each embodiment is described in further detail below.

First Embodiment

Figure 5:
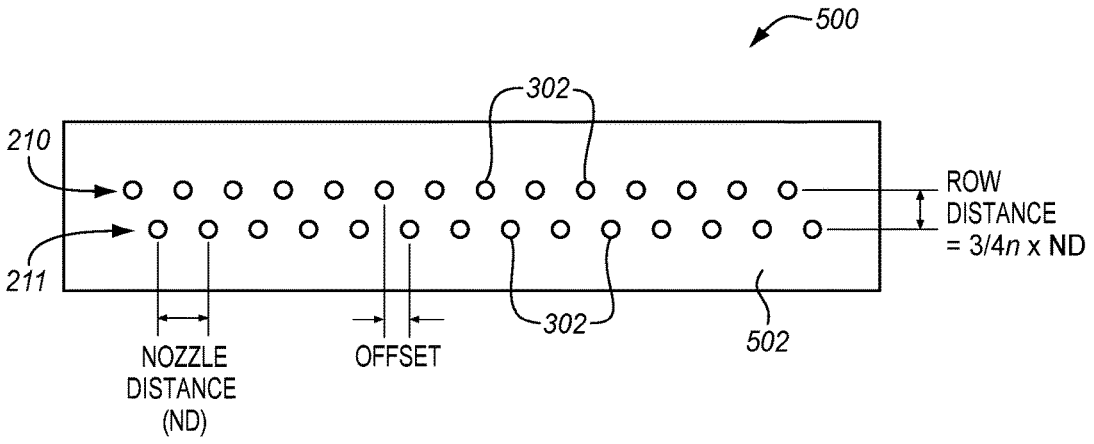
FIG. 5 illustrates a printhead in an illustrative embodiment.

FIG. 5 illustrates a printhead 500 for the first embodiment. The view in FIG. 5 shows a nozzle plate 502 of printhead 500, and printhead 500 may have a structure similar to printhead 200 shown in FIGS. 2 and 3A-3C. Nozzle plate 502 has rows 210-211 of nozzles 302 as described above, but may have more or less rows in other embodiments. In this embodiment, printhead 500 is designed so that the row distance is ¾n×ND, although FIG. 5 is not necessarily drawn to scale. When the row distance is set to this value, printhead 500 may be mounted in a jetting apparatus at two different angles for printing. The first angle is perpendicular (e.g., 90°) to the direction of relative movement between printhead 500 and the medium being marked. The second angle is in the range of 36°-38° to the direction of relative movement between printhead 500 and the medium being marked. To be more precise, the second angle may be calculated based on the 3-4-5 triangle geometry as arccos (⅘), which rounds to 37°.

Figure 6:
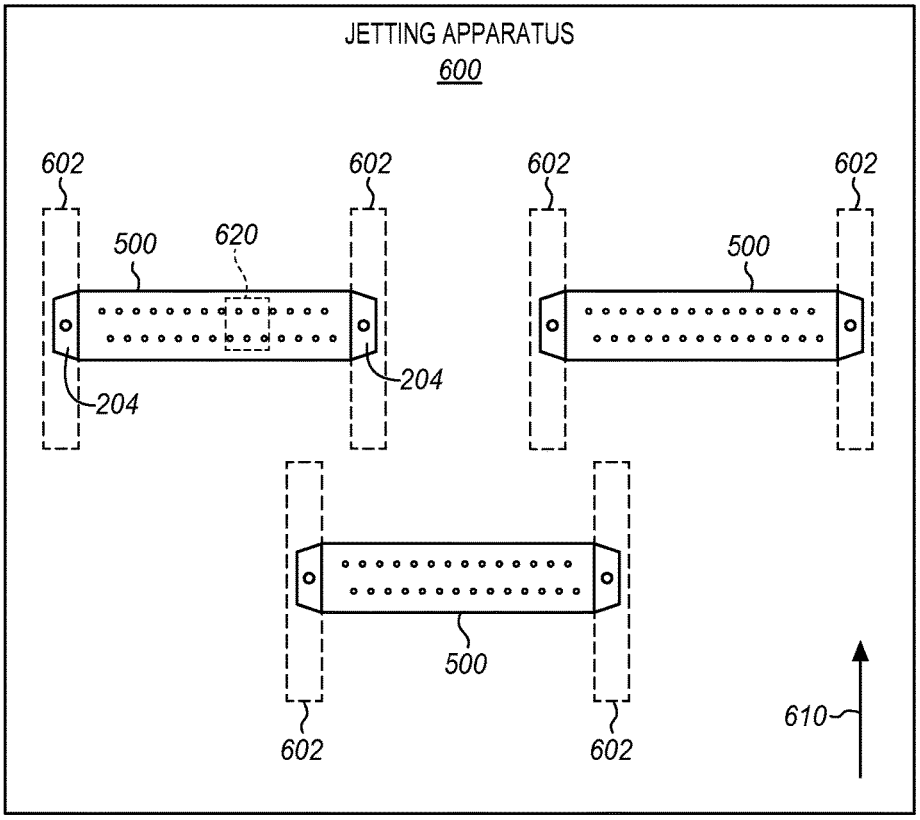
FIG. 6 illustrates multiple printheads mounted at the first angle in a jetting forming apparatus in an illustrative embodiment.

FIG. 6 illustrates multiple printheads 500 mounted at the first angle in a jetting apparatus 600 for the first embodiment. Jetting apparatus 600 includes a mount mechanism 602 that supports printheads 500. For example, printheads 500 may be connected to mount mechanism 602 via attachment members 204 (see also, FIG. 2). Arrow 610 illustrates the direction of relative movement between printheads 500 and the medium being marked by jetting apparatus 600. For example, arrow 610 may illustrate the scan direction of printheads 500, or the feed direction of the medium. Printheads 500 are oriented perpendicular to the direction of relative movement between printheads 500 and the medium in FIG. 6.

Figure 7:
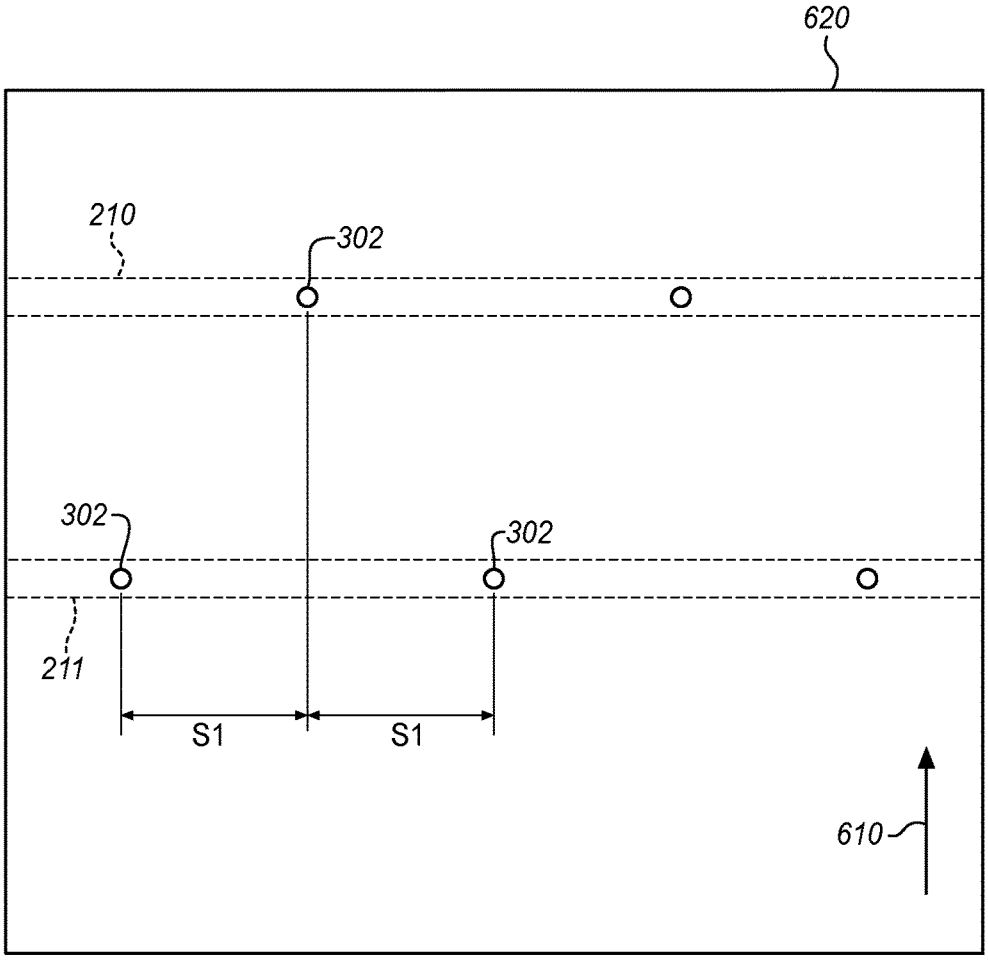
FIG. 7 is a zoomed view of a printhead mounted at the first angle in an illustrative embodiment.

FIG. 7 is a zoomed view of printhead 500 mounted at the first angle for the first embodiment, which is zoomed into region 620 of FIG. 6. When printheads 500 are oriented perpendicular to the direction of relative movement between printheads 500 and the medium, jetting apparatus 600 is able to print at a first resolution, which depends on the spacing S1 between adjacent nozzles 302 in rows 210-211.

Figure 8:
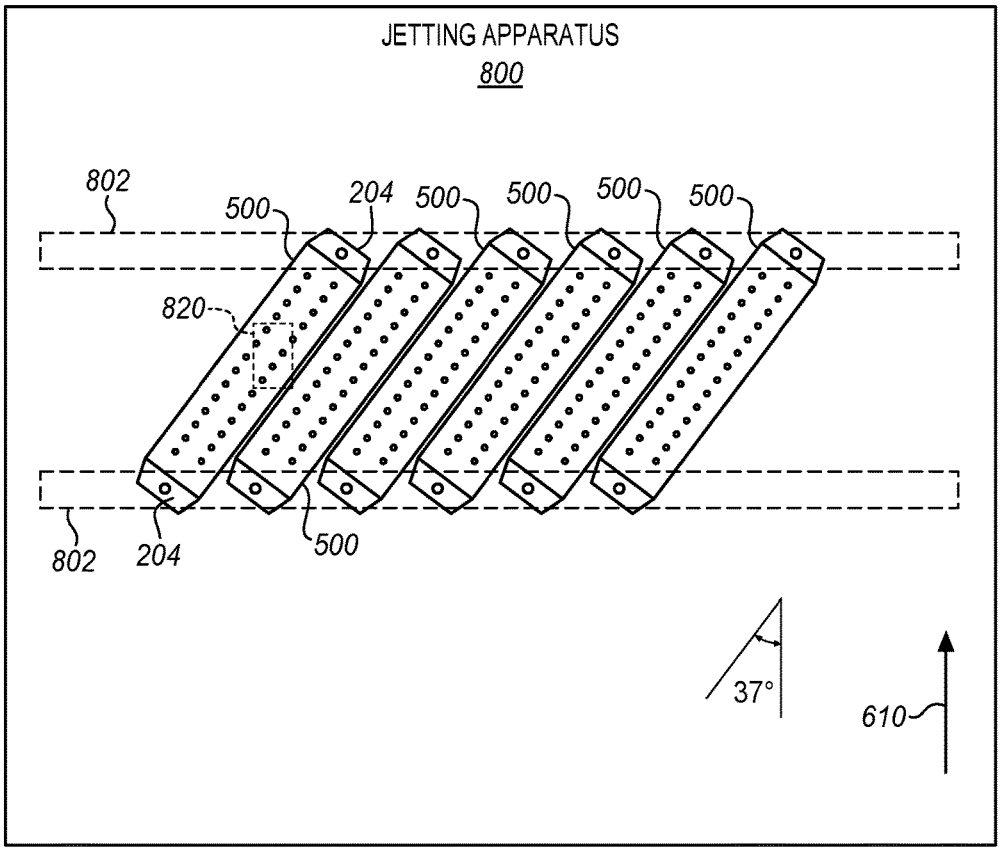
FIG. 8 illustrates printheads mounted at a second angle in a jetting apparatus in an illustrative embodiment.

FIG. 8 illustrates printheads 500 mounted at a second angle in a jetting apparatus 800 for the first embodiment. Jetting apparatus 800 includes a mount mechanism 802 that supports printheads 500. In this embodiment, mount mechanism 802 is perpendicular to the direction of relative movement indicated by arrow 610, and secures printheads 500 in a line so that attachment members 204 on one end of successive printheads 500 are aligned perpendicular to the direction of relative movement, and attachment members 204 on the other end of successive printheads 500 are aligned perpendicular to the direction of relative movement. However, attachment members 204 on opposing ends of each printhead 500 are offset so that printheads 500 are oriented at about 37° to the direction of relative movement between printheads 500 and the medium in FIG. 8. When oriented in this manner, the distance between a row of nozzles in one printhead 500 and an adjacent row of nozzles in a neighboring printhead 500 should have the same spacing as the row spacing (e.g., ¾n×ND) on the nozzle plate of each printhead 500. Therefore, there is a consistent spacing between rows on the same printhead 500 and between rows on adjacent printheads.

In this embodiment, printheads 500 are shown as being mounted in another jetting apparatus 800 than is shown in FIG. 6 for the perpendicular orientation. However, if mounting mechanism 602 in jetting apparatus 600 allows for mounting at different angles, then printheads 500 may be mounted in jetting apparatus 600 much as shown in FIG. 8.

Figure 9:
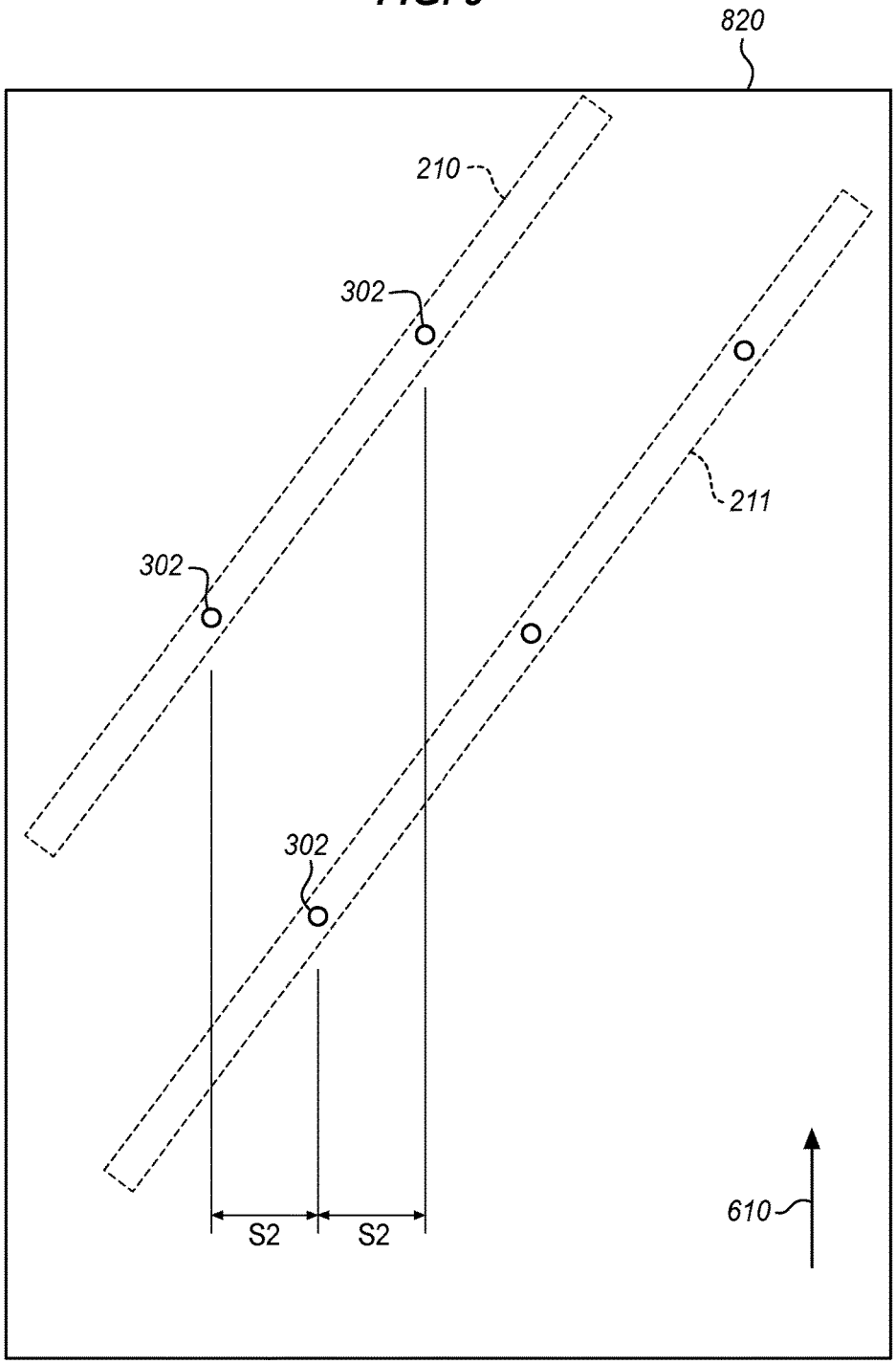
FIG. 9 is a zoomed view of a printhead mounted at the second angle in an illustrative embodiment.

FIG. 9 is a zoomed view of printhead 500 mounted at the second angle for the first embodiment, which is zoomed into region 820 of FIG. 8. When printheads 500 are oriented at about 37° to the direction of relative movement between printheads 500 and the medium, jetting apparatus 800 is able to print at a second resolution that is higher than the first resolution when printheads 500 are oriented perpendicular. When printheads 500 are oriented at this angle, the spacing S2 between adjacent nozzles 302 in rows 210-211 is smaller than the spacing S1 when printheads 500 are oriented perpendicular (see FIG. 7). The spacing S2 is about three-fifths of the spacing S1 so that the resolution is about 1.67 times higher. For example, if the resolution is 720 Dots Per Inch (dpi) when printheads 500 are oriented perpendicular, then the resolution may be increased to 1200 dpi when printheads 500 are oriented at about 37°. Thus, the same printhead 500 may be used at different angles to print at different resolutions due to its design.

Figure 10:
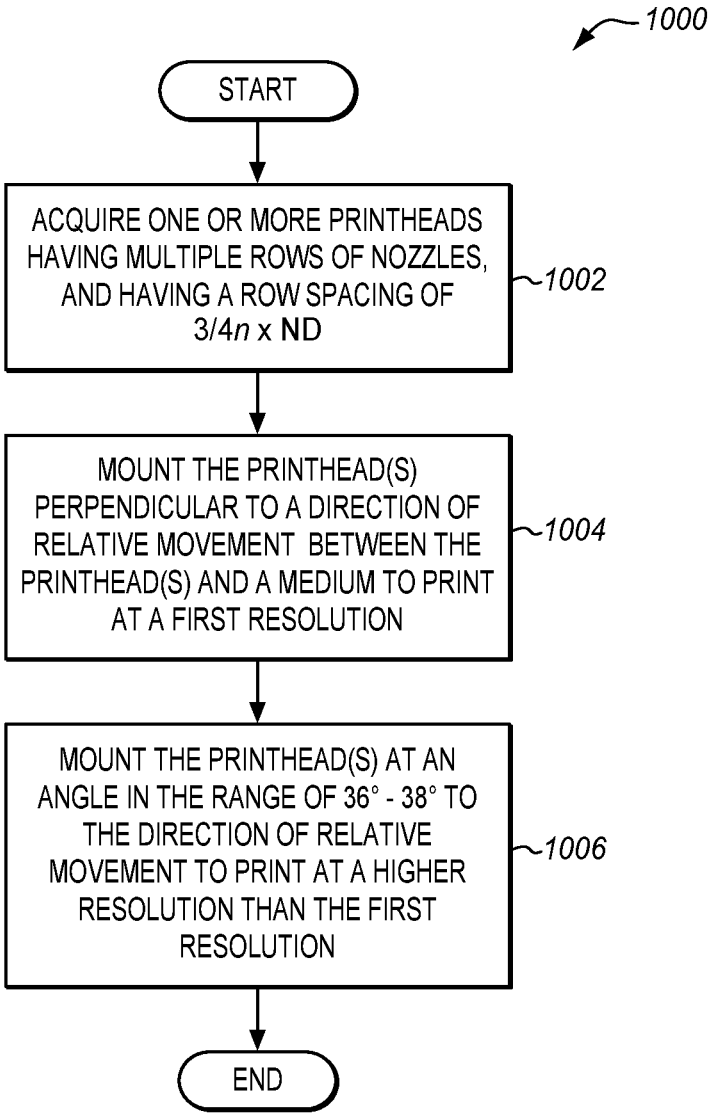
FIG. 10 is a flow chart illustrating a method of using a printhead in an illustrative embodiment.

FIG. 10 is a flow chart illustrating a method 1000 of using printhead 500 for the first embodiment. The steps of the methods described herein are not all inclusive and may include other steps not shown. Also, the steps of the methods may be performed in an alternative order. To begin, an operator acquires one or more printheads 500 that have the design characteristics described above (step 1002). For example, printhead 500 has multiple rows 210-211 of nozzles 302 that are aligned in parallel, and the spacing between rows is ¾n×ND. The operator may mount printhead 500 or multiple printheads 500 in a jetting apparatus perpendicular to the direction of relative movement between printhead 500 and the medium being marked to print at a first resolution (step 1004). The operator may mount printhead 500 or multiple printheads 500 in the same or another jetting apparatus at an angle in the range of 36°-38° to the direction of relative movement between printhead 500 and the medium being marked to print at a second resolution that is higher than the first resolution (step 1006). Thus, the same printhead 500 may be used to print at different resolutions by changing the angle in which it is mounted in a jetting apparatus.

Second Embodiment

Figure 11:
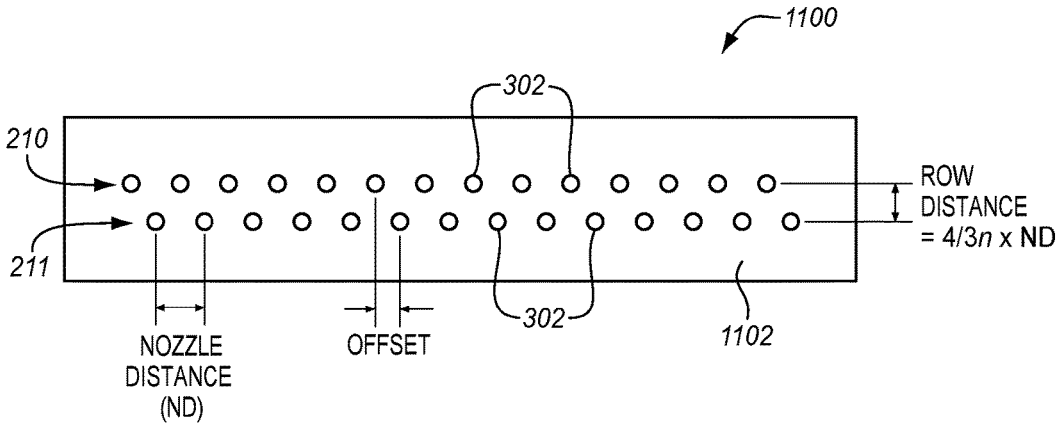
FIG. 11 illustrates a printhead in an illustrative embodiment.

FIG. 11 illustrates a printhead 1100 for the second embodiment. The view in FIG. 11 shows a nozzle plate 1102 of printhead 1100, and printhead 1100 may have a structure similar to printhead 200 shown in FIGS. 2 and 3A-3C. Nozzle plate 1102 has rows 210-211 of nozzles 302 as described above, but may have more or less rows in other embodiments. In this embodiment, printhead 1100 is designed so that the row distance is ⅘n×ND, although FIG. 11 is not necessarily drawn to scale. When the row distance is set to this value, printhead 1100 may be mounted in a jetting apparatus at two different angles for printing. The first angle is perpendicular (e.g., 90°) to the direction of relative movement between printhead 1100 and the medium being marked. The second angle is in the range of 52°-54° to the direction of relative movement between printhead 1100 and the medium being marked. To be more precise, the second angle may be calculated based on the 3-4-5 triangle geometry as arccos (⅗), which rounds to 53°.

Figure 12:
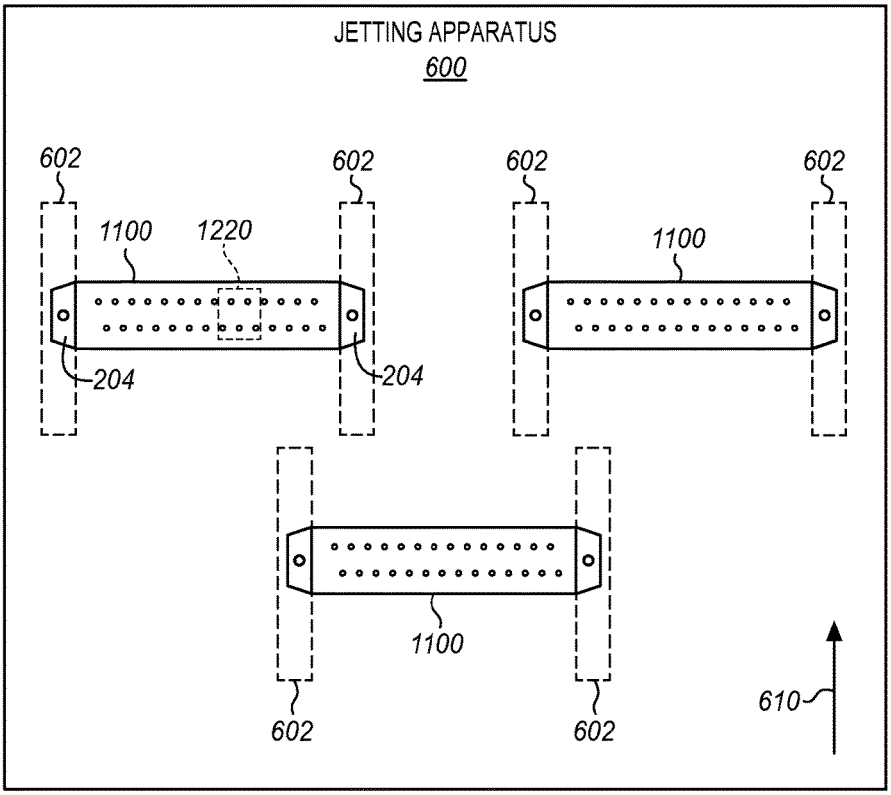
FIG. 12 illustrates multiple printheads mounted at a first angle in a jetting apparatus in an illustrative embodiment.

FIG. 12 illustrates multiple printheads 1100 mounted at the first angle in jetting apparatus 600 for the second embodiment. As described above, jetting apparatus 600 includes mount mechanism 602 that supports printheads 1100. Printheads 1100 are oriented perpendicular to the direction of relative movement between printheads 1100 and the medium in FIG. 12.

Figure 13:
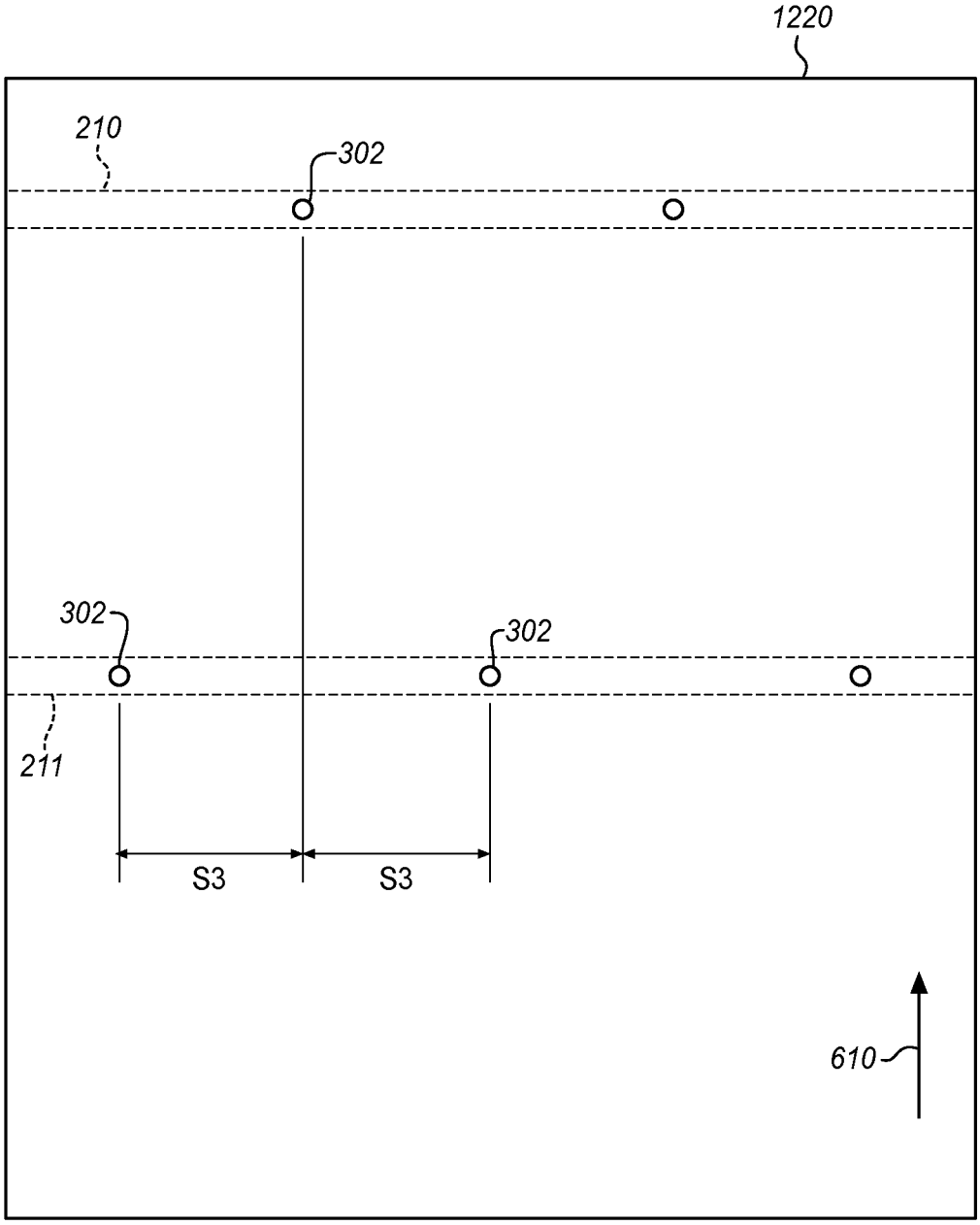
FIG. 13 is a zoomed view of a printhead mounted at the first angle in an illustrative embodiment.

FIG. 13 is a zoomed view of printhead 1100 mounted at the first angle for the second embodiment, which is zoomed into region 1220 of FIG. 12. When printheads 1100 are oriented perpendicular to the direction of relative movement between printheads 1100 and the medium, jetting apparatus 600 is able to print at a first resolution, which depends on the spacing S3 between adjacent nozzles 302 in rows 210-211.

Figure 14:
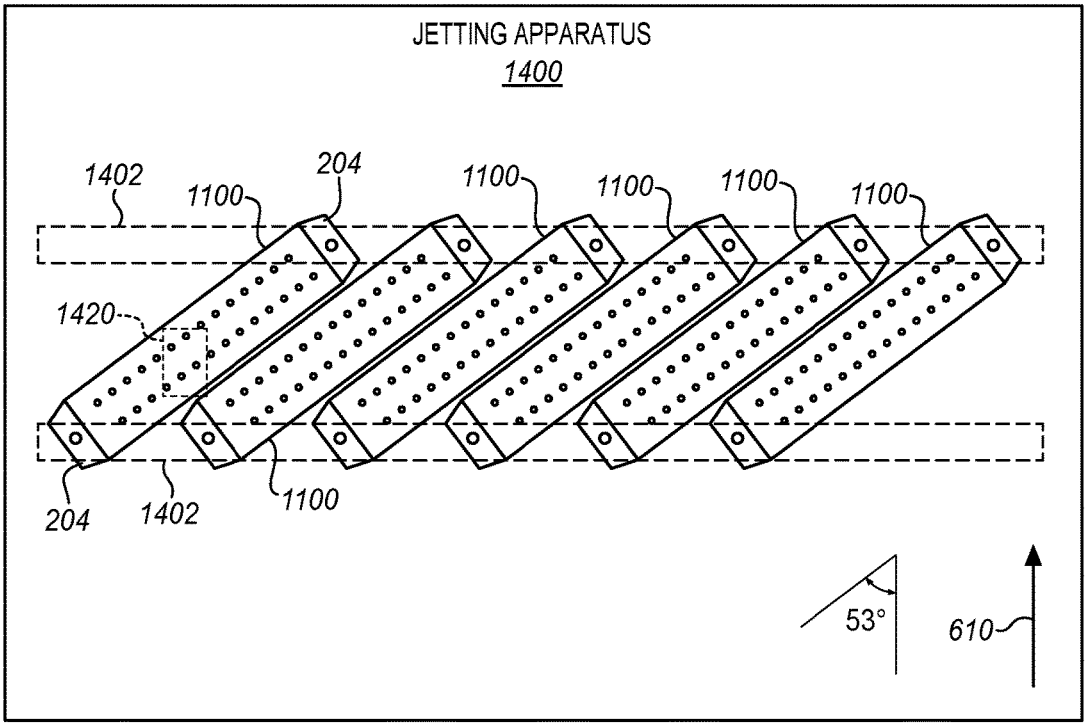
FIG. 14 illustrates printheads mounted at a second angle in a jetting apparatus in an illustrative embodiment.

FIG. 14 illustrates printheads 1100 mounted at a second angle in a jetting apparatus 1400 for the second embodiment. Jetting apparatus 1400 includes a mount mechanism 1402 that supports printheads 1100. In this embodiment, mount mechanism 1402 is perpendicular to the direction of relative movement indicated by arrow 610, and secures printheads 1100 in a line so that attachment members 204 on one end of successive printheads 1100 are aligned perpendicular to the direction of relative movement, and attachment members 204 on the other end of successive printheads 1100 are aligned perpendicular to the direction of relative movement. However, attachment members 204 on opposing ends of each printhead 1100 are offset so that printheads 1100 are oriented at about 53° to the direction of relative movement between printheads 1100 and the medium in FIG. 14. When oriented in this manner, the distance between a row of nozzles in one printhead 1100 and an adjacent row of nozzles in a neighboring printhead 1100 should have the same spacing (e.g., ⅘n×ND) as the row spacing on the nozzle plate of each printhead 1100. Therefore, there is a consistent spacing between rows on the same printhead 1100 and between rows on adjacent printheads.

In this embodiment, printheads 1100 are shown as being mounted in another jetting apparatus 1400 than is shown in FIG. 12 for the perpendicular orientation. However, if mounting mechanism 602 in jetting apparatus 600 allows for mounting at different angles, then printheads 1100 may be mounted in jetting apparatus 600 much as shown in FIG. 14.

Figure 15:
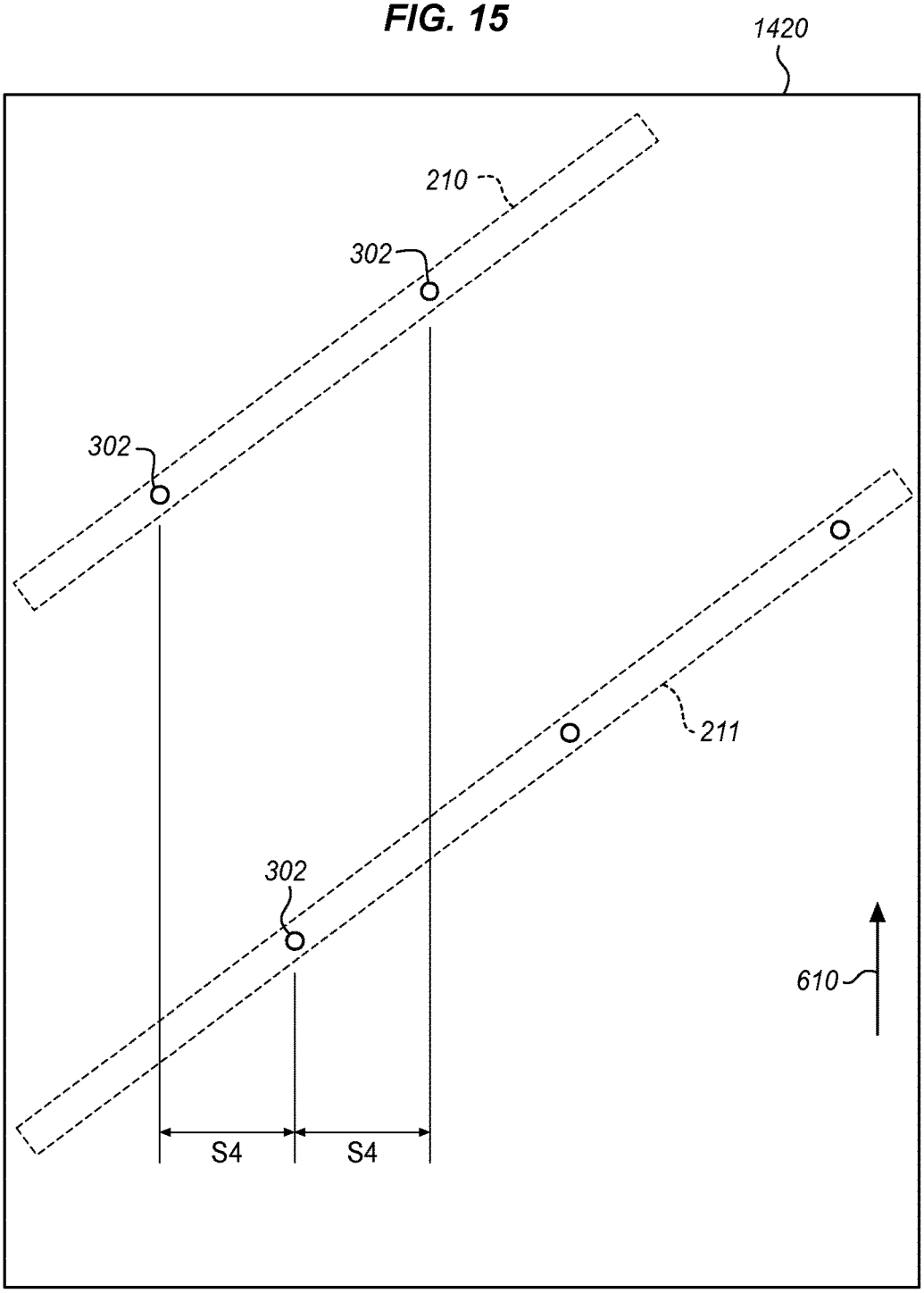
FIG. 15 is a zoomed view of a printhead mounted at the second angle in an illustrative embodiment.

FIG. 15 is a zoomed view of printhead 1100 mounted at the second angle for the second embodiment, which is zoomed into region 1420 of FIG. 14. When printheads 1100 are oriented at about 53° to the direction of relative movement between printheads 1100 and the medium, jetting apparatus 1400 is able to print at a second resolution that is higher than the first resolution when printheads 1100 are oriented perpendicular (see FIG. 13). The spacing S4 is about fourth-fifths the spacing S3, so that the resolution is about 1.25 times higher. For example, if the resolution is 720 dpi when printheads 500 are oriented perpendicular, then the resolution may be increased to 900 dpi when printheads 500 are oriented at about 37°. Thus, the same printhead 1100 may be used at different angles to print at different resolutions due to its design.

Figure 16:
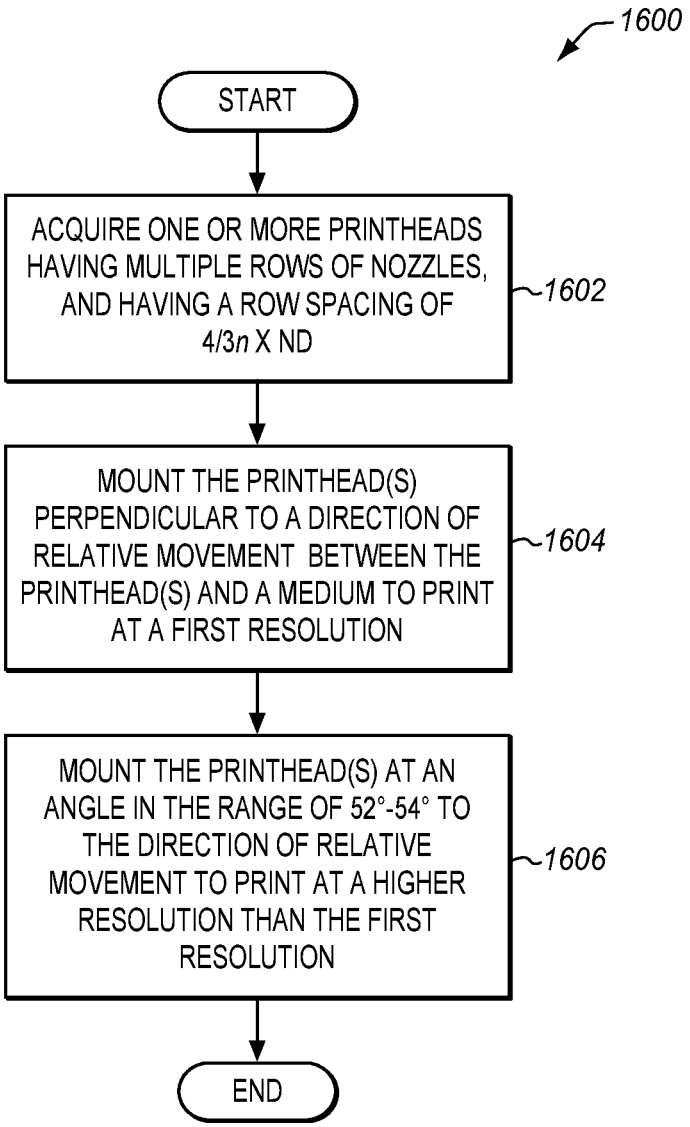
FIG. 16 is a flow chart illustrating a method of using a printhead in an illustrative embodiment.

FIG. 16 is a flow chart illustrating a method 1600 of using printhead 1100 for the second embodiment. To begin, an operator acquires one or more printheads 1100 that have the design characteristics described above (step 1602). For example, printhead 1100 has multiple rows 210-211 of nozzles 302 that are aligned in parallel, and the spacing between rows is ⅘n×ND. The operator may mount printhead 1100 or multiple printheads 1100 in a jetting apparatus perpendicular to the direction of relative movement between printhead 1100 and the medium being marked to print at a first resolution (step 1604). The operator may mount printhead 1100 or multiple printheads 1100 in the same or another jetting apparatus at an angle in the range of 52°-54° (e.g., about) 53° to the direction of relative movement between printhead 1100 and the medium being marked to print at a second resolution that is higher than the first resolution (step 1606). Thus, the same printhead 1100 may be used to print at different resolutions by changing the angle in which it is mounted in a jetting apparatus.

Third Embodiment

Figure 17:
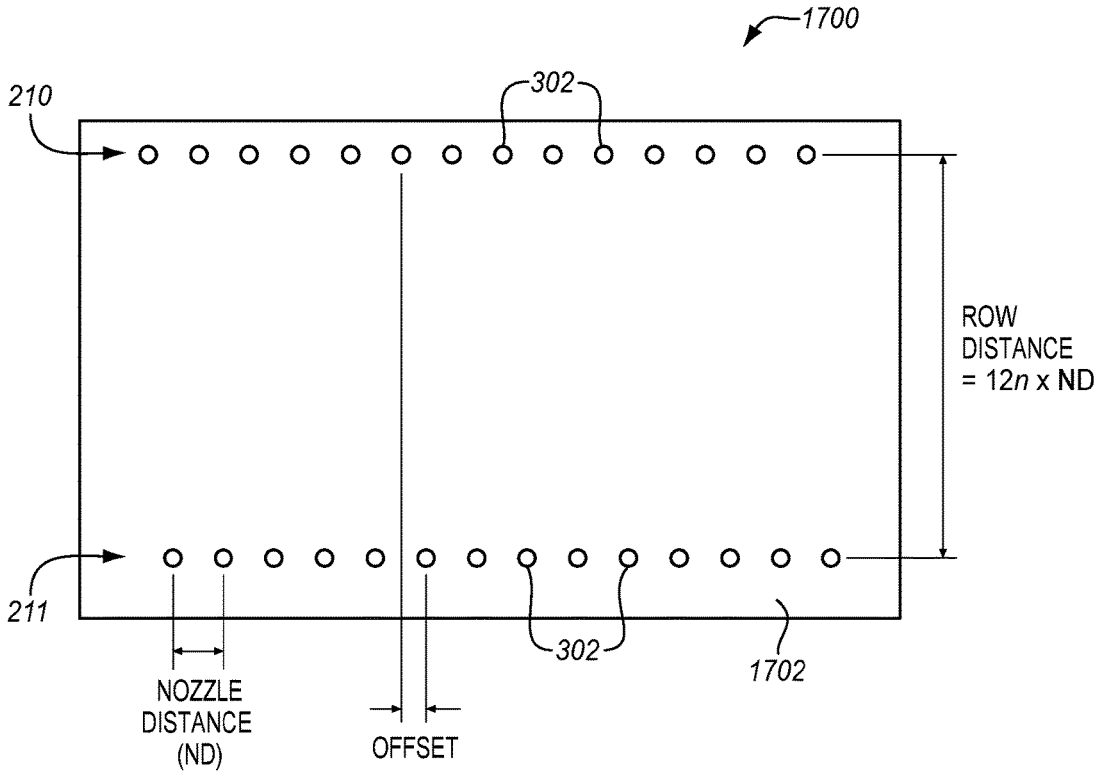
FIG. 17 illustrates a printhead in an illustrative embodiment.

FIG. 17 illustrates a printhead 1700 for the third embodiment. The view in FIG. 17 shows a nozzle plate 1702 of printhead 1700, and printhead 1700 may have a structure similar to printhead 200 shown in FIGS. 2 and 3A-3C. Nozzle plate 1702 has rows 210-211 of nozzles 302 as described above, but may have more or less rows in other embodiments. In this embodiment, printhead 1700 is designed so that the row distance is 12n×ND, although FIG. 17 is not necessarily drawn to scale. When the row distance is set to this value, printhead 1700 may be mounted in a jetting apparatus at three different angles for printing. The first angle is perpendicular (e.g., 90°) to the direction of relative movement between printhead 1700 and the medium being marked. Printhead 1700 may be mounted similar to printheads 500 in FIG. 6 perpendicular to the direction of relative movement. The second angle is in the range of 36°-38° to the direction of relative movement between printhead 1700 and the medium being marked. To be more precise, the second angle may be calculated based on the 3-4-5 triangle geometry as arccos (⅘), which rounds to 37°. Printhead 1700 may be mounted similar to printheads 500 in FIG. 8 at about a 37° angle to the direction of relative movement. The third angle is in the range of 52°-54° to the direction of relative movement between printhead 1700 and the medium being marked. To be more precise, the third angle may be calculated based on the 3-4-5 triangle geometry as arccos (⅗), which rounds to 53°, Printhead 1700 may be mounted similar to printheads 1100 in FIG. 14 at about a 53° angle to the direction of relative movement. When oriented at an angle of about 37° or about 53°, the distance between a row of nozzles in one printhead 1700 and an adjacent row of nozzles in a neighboring printhead 1700 should have the same spacing (e.g., 12n×ND) as the row spacing on the nozzle plate of each printhead 1700. Therefore, there is a consistent spacing between rows on the same printhead 1700 and between rows on adjacent printheads.

When printhead 1700 is mounted at the second angle (i.e., in the range of 36°-38° to the direction of relative movement between printhead 1700 and the medium being marked), the resolution is 1.67 times higher as compared to when printhead 1700 is mounted perpendicular. When printhead 1700 is mounted at the third angle (i.e., in the range of 52°-54° to the direction of relative movement between printhead 1700 and the medium being marked), the resolution is 1.25 times higher as compared to when printhead 1700 is mounted perpendicular. For example, if the resolution is 720 dpi when printheads 1700 are oriented perpendicular, then the resolution may be increased to 900 dpi when printheads 1700 are oriented at about 53°, and may be increased to 1200 dpi when printheads 1700 are oriented at about 37°.

Figure 18:
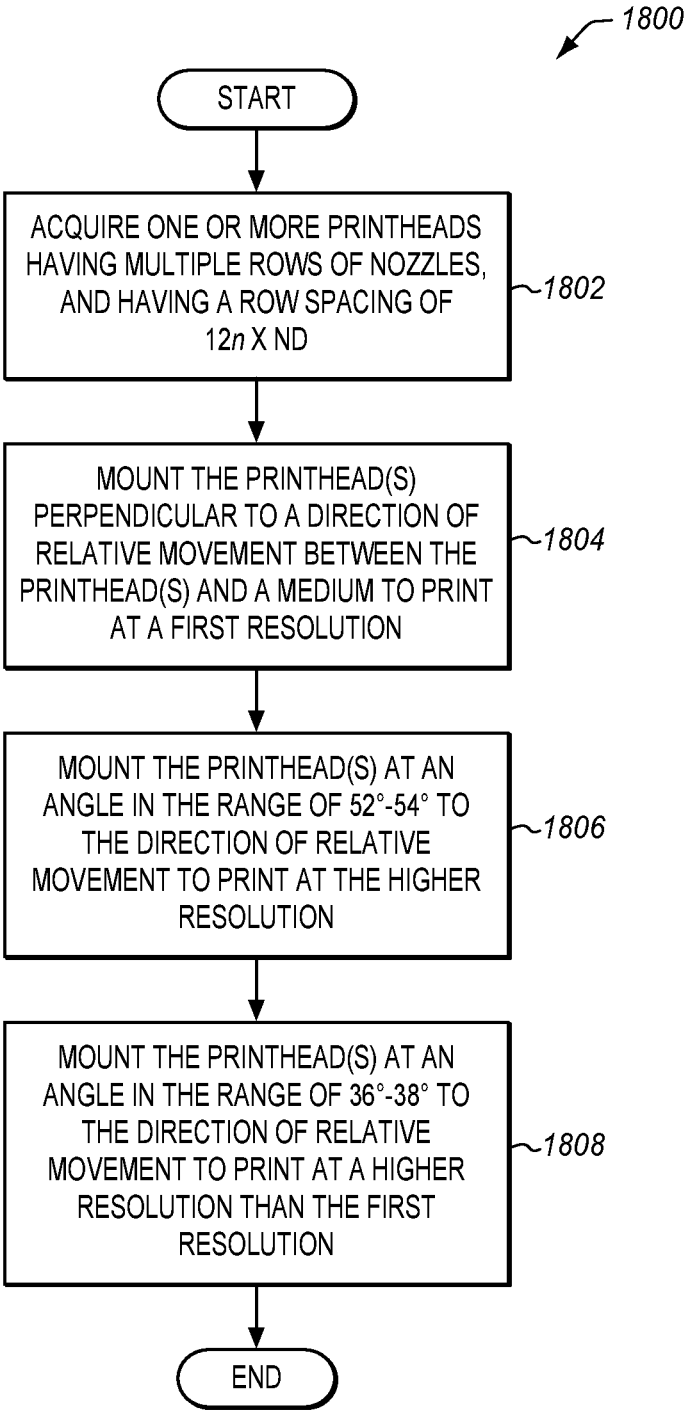
FIG. 18 is a flow chart illustrating a method of using a printhead in an illustrative embodiment.

FIG. 18 is a flow chart illustrating a method 1800 of using printhead 1700 for the third embodiment. To begin, an operator acquires one or more printheads 1700 that have the design characteristics described above (step 1802). For example, printhead 1700 has multiple rows 210-211 of nozzles 302 that are aligned in parallel, and the spacing between rows is 12n×ND. The operator may mount printhead 1700 or multiple printheads 1700 in a jetting apparatus perpendicular to the direction of relative movement between printhead 1700 and the medium being marked to print at a first resolution (step 1804). The operator may mount printhead 1700 or multiple printheads 1700 in the same or another jetting apparatus at an angle in the range of 52°-54° (e.g., about) 53° to the direction of relative movement between printhead 1700 and the medium being marked to print at a second resolution that is higher than the first resolution (step 1806). The operator may mount printhead 1700 or multiple printheads 1700 in the same or another jetting apparatus at an angle in the range of 36°-38° (e.g., about 37°) to the direction of relative movement between printhead 1700 and the medium being marked to print at a third resolution that is higher than the first resolution and the second resolution (step 1808). Thus, the same printhead 1700 may be used to print at different resolutions by changing the angle in which it is mounted in a jetting.

Although specific embodiments were described herein, the scope of the invention is not limited to those specific embodiments. The scope of the invention is defined by the following claims and any equivalents thereof.

What is claimed is:

1. An apparatus comprising:
at least one printhead having:
a nozzle plate with nozzles arranged in rows that are parallel; and
attachment members;
the nozzles in each of the rows are spaced by a nozzle distance;
the nozzles in one row are offset from the nozzles in other rows;
the rows of nozzles are spaced at a distance of ¾n times the nozzle distance, where n is a natural number;
the at least one printhead mounts in a jetting apparatus in a configuration selected from:
the attachment members connect to a mount mechanism of the jetting apparatus to orient the at least one printhead at a first angle that is perpendicular to a direction of relative movement between the at least one printhead and a print medium to print at a first resolution; and
the attachment members connect to the mount mechanism of the jetting apparatus to orient the at least one printhead at a second angle to the direction of relative movement between the at least one printhead and the print medium to print at a higher resolution than the first resolution, wherein the second angle is in a range of 36 and 38 degrees.

2. The apparatus of claim 1 wherein:
the second angle comprises arccos(⅘) degrees.

3. The apparatus of claim 1 wherein:
the at least one printhead includes a first printhead and a second printhead connected to the mount mechanism of the jetting apparatus at the second angle; and
a first row of nozzles in the first printhead is spaced at the distance of ¾n times the nozzle distance from a second row of nozzles in the second printhead.

4. The apparatus of claim 1 wherein:
the rows of nozzles include a first row and a second row; and
the nozzles in the first row are offset from the nozzles in the second row by ½ times the nozzle distance.

5. The apparatus of claim 1 wherein:
the jetting apparatus comprises an inkjet printer.

6. The apparatus of claim 5 wherein:
the inkjet printer performs single-pass printing.

7. An apparatus comprising:
at least one printhead having:
a nozzle plate with nozzles arranged in rows that are parallel; and
attachment members;
the nozzles in each of the rows are spaced by a nozzle distance;
the nozzles in one row are offset from the nozzles in other rows;
the rows of nozzles are spaced at a distance of ⅘n times the nozzle distance, where n is a natural number;
the at least one printhead mounts in a jetting apparatus in a configuration selected from:
the attachment members connect to a mount mechanism of the jetting apparatus to orient the at least one printhead at a first angle that is perpendicular to a direction of relative movement between the at least one printhead and a print medium to print at a first resolution; and
the attachment members connect to the mount mechanism of the jetting apparatus to orient the at least one printhead at a second angle to the direction of relative movement between the at least one printhead and the print medium to print at a higher resolution than the first resolution, wherein the second angle is in a range of 52 and 54 degrees.

8. The apparatus of claim 7 wherein:
the second angle comprises arccos(⅗) degrees.

9. The apparatus of claim 7 wherein:
the at least one printhead includes a first printhead and a second printhead connected to the mount mechanism of the jetting apparatus at the second angle; and
a first row of nozzles in the first printhead is spaced at the distance of ⅘n times the nozzle distance from a second row of nozzles in the second printhead.

10. The apparatus of claim 7 wherein:
the rows of nozzles include a first row and a second row; and
the nozzles in the first row are offset from the nozzles in the second row by ½ times the nozzle distance.

11. The apparatus of claim 7 wherein:
the jetting apparatus comprises an inkjet printer.

12. The apparatus of claim 11 wherein:
the inkjet printer performs single-pass printing.

13. An apparatus comprising:
at least one printhead having:
a nozzle plate with nozzles arranged in rows that are parallel; and
attachment members;

the nozzles in each of the rows are spaced by a nozzle distance;

the nozzles in one row are offset from the nozzles in other rows;

the rows of nozzles are spaced at a distance of 12n times the nozzle distance, where n is a natural number;

the at least one printhead mounts in a jetting apparatus in a configuration selected from:

the attachment members connect to a mount mechanism of the jetting apparatus to orient the at least one printhead at a first angle that is perpendicular to a direction of relative movement between the at least one printhead and a print medium to print at a first resolution;

the attachment members connect to the mount mechanism of the jetting apparatus to orient the at least one printhead at a second angle to the direction of relative movement between the at least one printhead and the print medium to print at a second resolution that is higher than the first resolution, wherein the second angle is in a range of 52 and 54 degrees; and the attachment members connect to the mount mechanism of the jetting apparatus to orient the at least one printhead at a third angle to the direction of relative movement between the at least one printhead and the print medium to print at a third resolution that is higher than the first resolution and the second resolution, wherein the third angle is in a range of 36 and 38 degrees.

14. The apparatus of claim 13 wherein:

the second angle comprises arccos(3/5) degrees.

15. The apparatus of claim 13 wherein:

the third angle comprises arccos(4/5) degrees.

16. The apparatus of claim 13 wherein:

the at least one printhead includes a first printhead and a second printhead connected to the mount mechanism of the jetting apparatus at the second angle or the third angle; and a first row of nozzles in the first printhead is spaced at the distance of 12n times the nozzle distance from a second row of nozzles in the second printhead.

17. The apparatus of claim 13 wherein:

the rows of nozzles include a first row and a second row; and the nozzles in the first row are offset from the nozzles in the second row by ½ times the nozzle distance.

18. The apparatus of claim 13 wherein:

the jetting apparatus comprises an inkjet printer.

19. The apparatus of claim 18 wherein:

the inkjet printer performs single-pass printing.

* * * * *